US008470406B2

(12) United States Patent
Kobayashi et al.

(10) Patent No.: US 8,470,406 B2
(45) Date of Patent: Jun. 25, 2013

(54) METHOD OF SPRAY APPLICATION, AND SPRAY APPARATUS, FOR BENTONITE MATERIAL

(75) Inventors: Ichizo Kobayashi, Tokyo (JP); Takeshi Sasakura, Tokyo (JP); Toshiyuki Tanaka, Tokyo (JP); Makoto Nakajima, Tokyo (JP); Masaru Toida, Tokyo (JP); Takahisa Isobe, Tokyo (JP)

(73) Assignee: Kajima Corporation, Tokyo (JP)

( * ) Notice: Subject to any disclaimer, the term of this patent is extended or adjusted under 35 U.S.C. 154(b) by 1183 days.

(21) Appl. No.: 12/064,004

(22) PCT Filed: Aug. 10, 2006

(86) PCT No.: PCT/JP2006/315818
§ 371 (c)(1),
(2), (4) Date: May 7, 2008

(87) PCT Pub. No.: WO2007/020868
PCT Pub. Date: Feb. 22, 2007

(65) Prior Publication Data

US 2009/0252881 A1 Oct. 8, 2009

(30) Foreign Application Priority Data

Aug. 19, 2005 (JP) ..... P2005 238738

(51) Int. Cl.
*B05D 1/02* (2006.01)

(52) U.S. Cl.
USPC ..... 427/421.1; 427/427; 239/398

(58) Field of Classification Search
USPC ..... 427/421.1; 239/398
See application file for complete search history.

(56) References Cited

U.S. PATENT DOCUMENTS

2004/0166247 A1* 8/2004 Heinrich et al. ..... 427/446
2005/0161532 A1 7/2005 Steenkiste et al.

FOREIGN PATENT DOCUMENTS

| | | | |
|---|---|---|---|
| JP | 63-141664 | * | 6/1988 |
| JP | 09-288200 | | 11/1997 |
| JP | 09-288200 A | | 11/1997 |
| JP | 11-280081 | * | 10/1999 |
| JP | 11-280081 A | | 10/1999 |
| JP | 2000-193796 | | 7/2000 |
| JP | 2001-081761 | | 3/2001 |

OTHER PUBLICATIONS

International Search Report for PCT/JP2006/315818, mailed Sep. 12, 2006.
Canadian Office Action for App. No. 2,619,405, mailed Mar. 23, 2010, 3 pgs.

(Continued)

*Primary Examiner* — Kelly M Gambetta
*Assistant Examiner* — Nathan T Leong
(74) *Attorney, Agent, or Firm* — Squire Sanders (US) LLP

(57) ABSTRACT

The present invention provides a spray method and spray apparatus for bentonite-based material that allow forming a bentonite layer of high dry density. A spray apparatus 1 comprises a supersonic nozzle 2, to which a compressor 5 and a bentonite container 6 are connected. The supersonic nozzle 2 is fed compressed air from the compressor 5 and a bentonite-based material from the bentonite container 6. The compressed air, mixed with the bentonite-based material, is accelerated to supersonic speed when passing through a constriction portion 14 of the supersonic nozzle 2, and is sprayed at supersonic speed out of a jet orifice 11.

5 Claims, 10 Drawing Sheets

OTHER PUBLICATIONS

Translation of International Preliminary Report on Patentability for PCT/JP2006/315818, Forms PCT/IB/338 and PCT/IPEA/409, mailed May 22, 2008 (6sheets).

Japanese Notice of Allowance of related application, Issued Oct. 4, 2011,2 pgs, without translation.

* cited by examiner

METHOD OF SPRAY APPLICATION, AND SPRAY APPARATUS, FOR BENTONITE MATERIAL

TECHNICAL FIELD

The present invention relates to a spray method and spray apparatus for bentonite-based material, and more particularly to a spray method and spray apparatus for bentonite-based material suitable for use in the building of waste disposal facilities for the treatment of waste such as radioactive waste or the like.

BACKGROUND ART

Radioactive waste is disposed, for instance, by radioactive waste geological disposal, in which the waste is melted into a vitreous material that is cast into iron or steel containers, the containers being then buried underground. In geological disposal of radioactive waste there are built artificial barriers (water-impervious layers) of a clayey material, with a view to reliably isolating the radioactive waste.

Known methods for building such artificial barriers include heaping of bentonite blocks, and on-site tamping. Methods for heaping up bentonite blocks involve transporting bentonite blocks manufactured in a factory or the like to a site, and then fixing the blocks by suction gripping or crane lifting. In an on-site tamping method, compaction is carried out, for instance, using a vibrating roller, a pneumatic striking hammer as an improved concrete chipper, or using a weight-drop automatic tamping machine. Methods for disposing such radioactive waste include, for instance, the waste disposal facility disclosed in Japanese Patent No. 3054728 (Patent document 1), and the backfill method and block manufacturing method used therein, disclosed in Japanese Unexamined Patent Application Laid-open No. 2000-193796 (Patent document 2).

As the clayey material there is ordinarily used a bentonite-based material having bentonite as a main constituent and comprising bentonite or a bentonite mixed soil in which bentonite contains sand or the like. Such a bentonite-based material is ordinarily used in the form of a raw material having a main constituent of bentonite powder to which there is added water to a predetermined water content.

A bentonite block heaping method, however, requires a substantial plant equipped with large jacks and the like. A method involving tamping on site is problematic in that it requires using major equipment items such as large vibration rollers and/or compacting machinery. These methods have drawbacks also in that they allow building an artificial barrier at narrow sites only with difficulty.

Spray methods using a bentonite-based material have been studied with a view to tackling the above problems. In such spray methods, a bentonite-based material is sprayed onto the inner surface of a tunnel or the like, to build thereby an artificial barrier (water-impervious layer). Conventional spray methods, directly mainly at enhancing imperviousness of a slope, are disclosed in, for instance, Japanese Unexamined Patent Application Laid-open No. 2001-81761 (Patent document 3) and Japanese Patent No. 3494397 (Patent document 4). Such spray methods do not require using large equipment such as jacks, vibrating rollers or the like, and hence allow building artificial barriers easily. They allow, moreover, building artificial barriers easily also in narrow sites.

Patent document 1: Japanese Patent No. 3054728

Patent document 2: Japanese Unexamined Patent Application Laid-open No. 2000-193796

Patent document 3: Japanese Unexamined Patent Application Laid-open No. 2001-81761

Patent document 4: Japanese Patent No. 3494397

DISCLOSURE OF THE INVENTION

The artificial barriers (water-impervious layers) built for geological disposal of radioactive waste must have high imperviousness to water, and hence must exhibit high dry density, for instance an extremely high dry density of about 1.6 $Mg/m^3$. However, the spray methods disclosed in Patent documents 3 and 4 are problematic in that they do not allow building artificial barriers of such high dry density. Bentonite layers (water-impervious layers) that afford high imperviousness to water through spraying of a bentonite-based material are not restricted to geological disposal of radioactive waste, but are demanded also for other structures.

Thus, it is an object of the present invention to provide a spray method and spray apparatus for bentonite-based material that allow forming a bentonite layer of high dry density.

The bentonite-based material spray method according to the present invention, which solves the above problems, comprises: supplying compressed air to a supersonic nozzle formed with a compression portion, a constriction portion, and an expansion portion, the compressed air being accelerated to supersonic speed in the process of being supplied to the expansion portion by passing through the constriction portion, and jetting the supersonic compressed air from a jet orifice formed downstream of the expansion portion; mixing a bentonite-based material with the compressed air; and forming a bentonite layer by spraying the bentonite-based material mixed with the compressed air.

In the bentonite-based material spray method according to the present invention a supersonic nozzle is used for spraying the bentonite-based material. Using such a supersonic nozzle allows spraying the bentonite-based material at a high speed. i.e. supersonic speed, which in turn allows forming a bentonite layer having high dry density. Examples of the "mixture containing bentonite" in the present invention include, for instance, mixtures of bentonite and cement, or mixtures of bentonite and sand and/or gravel.

Herein, the bentonite-based material is supplied to the supersonic nozzle mixed with a liquid. The bentonite-based material may be a mixture containing a main material and a liquid.

Thus, the bentonite-based material can be suitably used in so-called wet spraying, where the bentonite-based material is supplied to the supersonic nozzle mixed with a liquid.

The bentonite-based material spray method according to claim 2, comprises using, as the main material, a material having a dry density equal to or greater than a predetermined dry density when the content of the liquid in the bentonite-based material is an optimum water content in the main material; determining an upper limit of the content of the liquid in the bentonite-based material on the basis of the possibility of closing of the supersonic nozzle during passage of the bentonite-based material through the supersonic nozzle; and determining a lower limit of the content of the liquid in the bentonite-based material on the basis of the adherence of the bentonite-based material.

Using thus a bentonite-based material having a dry density equal to or greater than a predetermined dry density when the content of the liquid in the bentonite-based material is an optimum water content in the main material has the effect of allowing forming a bentonite layer having a predetermined dry density. The higher the water content of the bentonite-based material, the more likely it is that the supersonic nozzle becomes clogged. Thus, clogging of the supersonic nozzle by the bentonite-based material can be prevented by determining an upper limit of the content of the liquid in the bentonite-based material on the basis of the possibility of clogging of the supersonic nozzle during passage of the bentonite-based material through the supersonic nozzle. On the other hand, the lower the water content of the bentonite-based material, the lower the adhesion rate of the bentonite-based material becomes during formation of a bentonite layer. Thus, a decrease in the adhesion rate of the bentonite-based material can be prevented by determining a lower limit of the liquid in the bentonite-based material on the basis of the adherence of the bentonite-based material.

In the present invention, "clogging of the supersonic nozzle" includes, in addition to clogging of the body of the supersonic nozzle, clogging of piping when, for instance, there is provided piping for delivering bentonite-based material to the supersonic nozzle.

Herein, the predetermined dry density can be set to 1.6 ($Mg/m^3$).

Setting the predetermined dry density to 1.6 ($Mg/m^3$) allows forming a bentonite layer that satisfies the water imperviousness required in the construction of a waste disposal facility for disposal of waste such as radioactive waste or the like.

The upper limit of the content of the liquid in the bentonite-based material can be set to a value greater by 4% than an optimum water content.

Setting thus the upper limit of the content of the liquid in the bentonite-based material to a value greater by 4% than an optimum water content allows suitably preventing clogging of the supersonic nozzle by the bentonite-based material.

The lower limit of the content of the liquid in the bentonite-based material can be set to a value smaller by 1% than an optimum water content.

Setting thus the lower limit of the content of the liquid in the bentonite-based material to a value smaller by 1% than an optimum water content allows preventing a drop in the adherence rate of the bentonite-based material.

Also, the compressed air and the bentonite-based material can be mixed more towards the jet orifice than the constriction portion in the supersonic nozzle.

Causing thus the compressed air and the bentonite-based material to be mixed more towards the jet orifice than the constriction portion in the supersonic nozzle allows preventing the bentonite-based material from passing through the constriction portion. This affords as a result more design freedom for the outer diameter of the constriction portion, the shape of the expansion portion and so forth, as the constriction portion is then not limited by the maximum particle size of the bentonite-based material.

Moreover, the bentonite-based material can be sprayed more downward than a horizontal direction.

Orienting thus the spraying direction more downward than the horizontal direction allows reducing spraying losses. Moreover, the bentonite-based material need not be adhered to the work surface, and hence the amount of liquid such as water used can be kept to a minimum.

The bentonite-based material spraying nozzle according to the present invention, which solves the above problems, is a nozzle used in a bentonite spray apparatus forming a bentonite layer by spraying a bentonite-based material having as a main material thereof bentonite or a mixture containing bentonite, the nozzle comprising a supersonic nozzle for jetting at supersonic speed the bentonite-based material supplied by a bentonite-based material supply means, by way of compressed air supplied from a compressor.

Also, the bentonite-based material spray apparatus according to the present invention, which solves the above problems, is a bentonite spray apparatus for forming a bentonite layer by spraying a bentonite-based material having as a main material thereof bentonite or a mixture containing bentonite, the apparatus comprising the above bentonite-based material spraying nozzle; a compressor for supplying compressed air to the nozzle; and bentonite-based material supply means for supplying the bentonite-based material to the nozzle; wherein a bentonite layer is formed by jetting the bentonite-based material mixed with the compressed air, together with the compressed air, from the nozzle, and by spraying the bentonite-based material mixed with the compressed air.

The spray method and spray apparatus for bentonite-based material according to the present invention allow forming a bentonite layer having high dry density.

DESCRIPTION OF THE REFERENCE NUMERALS

Figure 1:
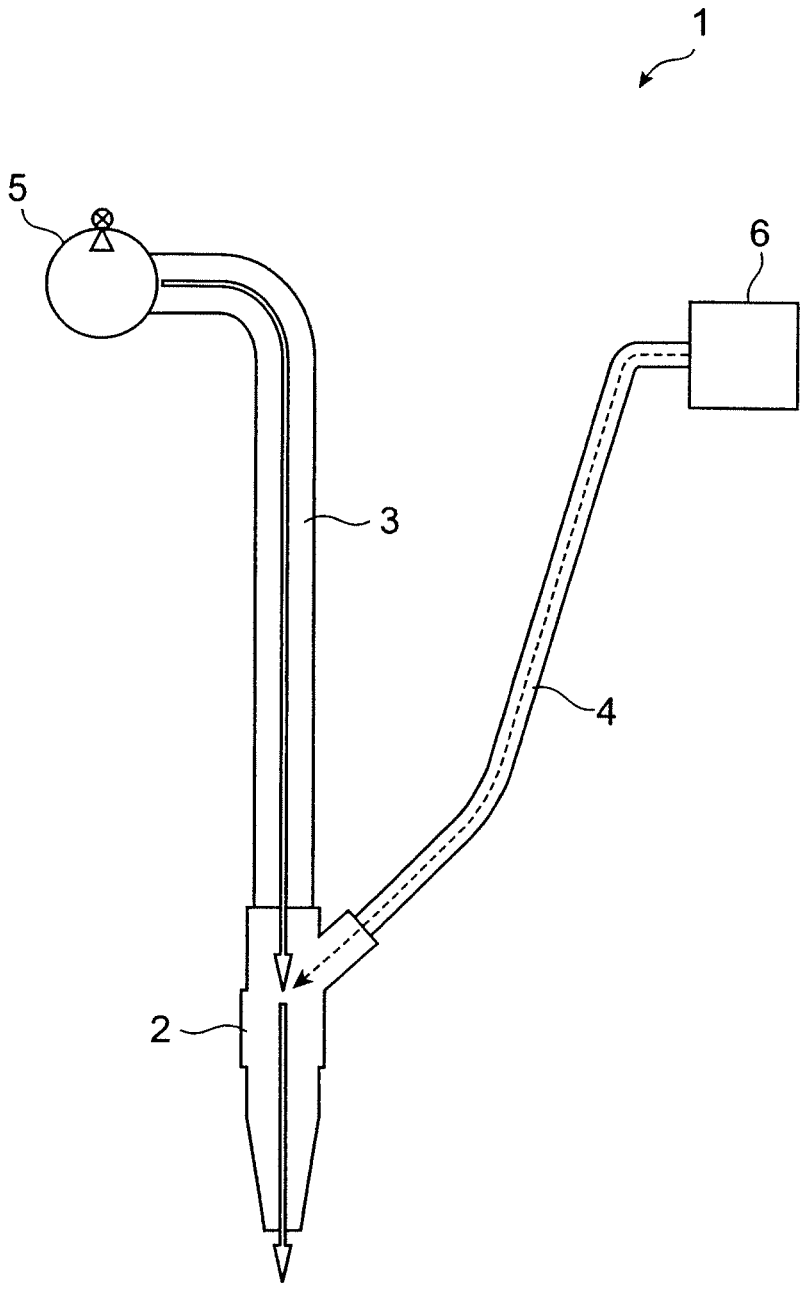
FIG. 1 is a schematic diagram illustrating a bentonite-based material spray apparatus according to the present invention.

1, 60 . . . spray apparatus
2, 40, 61 . . . supersonic nozzle
3 . . . first hose
4 . . . second hose
5, 63 . . . compressor
6, 64 . . . bentonite container (bentonite-based material supply means)
10, 41 . . . tip member
11 . . . jet orifice
12 . . . back-end opening
13 . . . channel
14 . . . constriction portion
15 . . . compression portion
16 . . . expansion portion
20, 42 . . . connecting member
21 . . . connecting member body
22, 43 . . . branch pipe member
24 . . . front end opening
25 . . . first connecting opening
26 . . . second connecting opening
30 . . . radioactive waste disposal facility
31 . . . gallery

32 . . . radioactive waste
33, 52 . . . water-impervious layer (bentonite layer)
50 . . . open-air waste disposal facility
32, 51 . . . (radioactive) waste
62 . . . three-way hose

BEST MODE FOR CARRYING OUT THE INVENTION

Preferred embodiments of the present invention are explained next with reference to accompanying drawings. FIG. 1 is a schematic diagram illustrating a bentonite-based material spray apparatus according to an embodiment of the present invention.

As illustrated in FIG. 1, a spray apparatus 1 according to the present embodiment comprises a supersonic nozzle 2 which is a nozzle for spraying bentonite-based material. The supersonic nozzle 2 is connected to one end of a first hose 3 and one end of a second hose 4. The other end of the first hose 3 is connected to a compressor 5, while the other end of the second hose 4 is connected to a bentonite container 6 as a bentonite-based material supply means.

Figure 2:
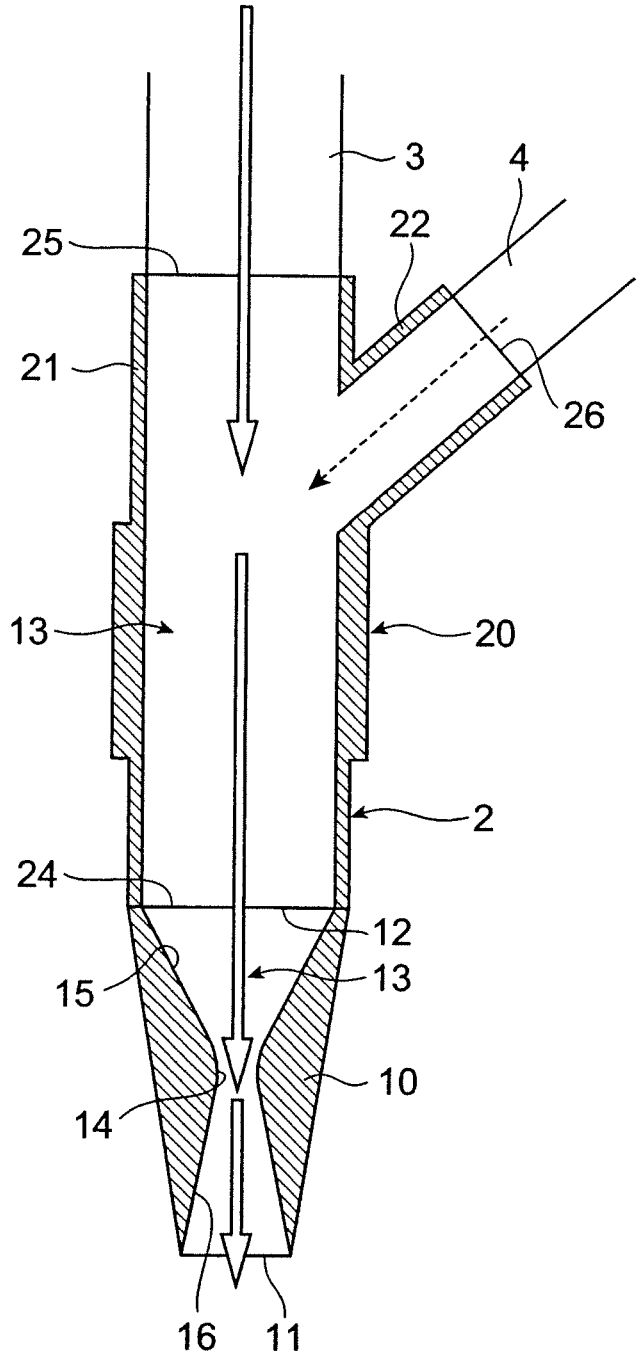
FIG. 2 is a cross-sectional diagram of a supersonic nozzle.

The supersonic nozzle 2, which is also called a Laval nozzle, has a tip member 10 and a connecting member 20, as illustrated in FIG. 2. On the front end of the tip member 10 there is formed a jet orifice 11, while on the back end of the tip member 10 there is formed a back-end opening 12. The connecting member 20 is connected to the back-end opening 12. Between the jet orifice 11 and the back-end opening 12 of the tip member 10 there is formed a channel 13, while on the channel 13 there is formed a constriction portion 14. Upstream from the constriction portion 14 of the channel 13 (toward the back-end opening 12), there is formed a compression portion 15 comprising a wide channel having a wider diameter than that of the constriction portion 14, while downstream of the constriction portion 14 (toward the jet orifice 11) there is formed an expansion portion 16 wider than the constriction portion 14 but having a smaller diameter than the compression portion 15.

In the supersonic nozzle 2, the flow velocity of compressed air supplied from the compression portion 15 of the channel 13 to the constriction portion 14 in the tip member 10 increases as the cross-sectional area decreases towards the constriction portion 14. Compressed air becomes supersonic by passing through the constriction portion 14, since a fluid such as air or the like, after passing through the constriction portion 14, becomes accelerated as it expands while passing through the expansion portion 16, to be eventually jetted through the jet orifice 11.

The connecting member 20 of the supersonic nozzle 2 has a connecting member body 21 in which there is provided a branch pipe member 22. On the front end of the connecting member body 21 there is formed a front end opening 24, while on the back end of the connecting member body 21 there is formed a first connecting opening 25. Also, a second connecting opening 26 is formed on the back end of the branch pipe member 22. Amongst these, the front end opening 24 is connected to the back-end opening 12 in the tip member 10. Also, the first hose 3 is connected to the first connecting opening 25, while the second hose 4 is connected to the second connecting opening 26.

The compressor 5 is connected to the first hose 3, while the bentonite container 6 is connected to the second hose 4. Herein, compressed air is supplied by operating the compressor 5. The bentonite container 6 holds a bentonite-based material as a spray material.

When the compressor 5 connected to the first hose 3 is operated, compressed air is supplied from the compressor 5 to the connecting member 20 of the supersonic nozzle 2 via the first hose 3. The compressed air supplied to the connecting member 20 of the supersonic nozzle 2 flows into the channel 13 of the tip member 10 via a channel formed in the connecting member body 21 of the connecting member 20. Upon passing through the constriction portion 14 in the channel 13, the compressed air is accelerated beyond sonic speed, and is further accelerated after traversing the constriction portion 14, to be jetted through the jet orifice 11.

When compressed air flows into the connecting member 20 of the supersonic nozzle 2 via the first hose 3 a negative pressure builds in the channel of the connecting member 20. This negative pressure causes the bentonite-based material stored in the bentonite container 6 to be suctioned into the connecting member 20, flowing into the channel of the connecting member 20.

In the channel of the connecting member 20 the compressed air supplied from the compressor 5 mixes with the bentonite-based material supplied from the bentonite container 6. The bentonite-based material mixed with the compressed air flows with the latter into the tip member 10, and is jetted through the jet orifice 111 at supersonic speed. The width of the constriction portion 14 in the supersonic nozzle 2 is set, in accordance with the power of the compressor 5, to such a width that the compressed air becomes supersonic upon passing through the constriction portion 14.

The bentonite-based material for building of waste disposal facilities according to the present embodiment (hereinafter "bentonite-based material") has bentonite ore and water. The bentonite ore used is sorted to a particle size not larger than 10 mm from among coarse-granular bentonite produced during the manufacture of bentonite powder. The dry density of the coarse-granular bentonite is about 1.8 to 1.9 $Mg/m^3$. Coarse granular bentonite not larger than 10 mm can be sorted through 10 mm-mesh sifting of crushed bentonite ore.

Figure 5:
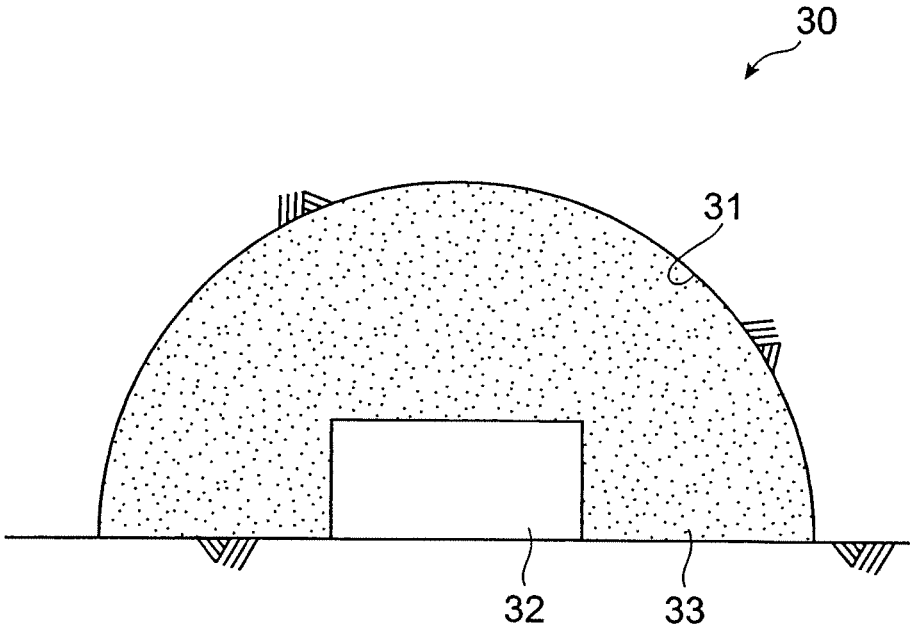
FIG. 5 is a front-view cross-sectional diagram of a radioactive waste disposal facility.

An explanation follows next on a method for developing a waste disposal facility in which there is carried out a spray method using the bentonite-based material according to the present embodiment. In the present embodiment there is developed a radioactive waste disposal facility for treating radioactive waste in which there is carried out geological disposal of the radioactive waste. FIG. 5 is a cross-sectional diagram of a radioactive waste disposal facility. As illustrated in FIG. 5, a radioactive waste disposal facility 30 has a gallery 31, such that radioactive waste 32 is disposed of by being buried in the gallery 31. For instance, the gallery 31 is formed of concrete. The radioactive waste 32 is melted into a vitreous material that is cast into an iron or steel container. For burying of the radioactive waste 32, a bentonite-based material is sprayed around the radioactive waste 32 forming a water-impervious layer 33 as a bentonite layer. The water-impervious layer 33 prevents the radioactive waste 32 from coming into contact with the flow of groundwater.

Figure 3:
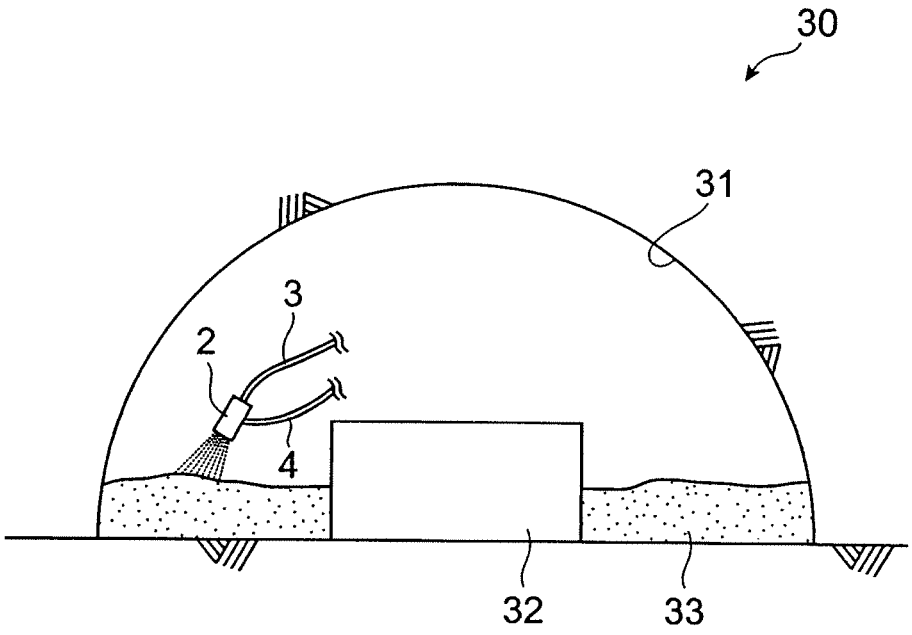
FIG. 3 is a front-view cross-sectional diagram of the building process of a radioactive waste disposal facility.

For the disposal of radioactive waste, firstly the radioactive waste 32 is placed in the gallery 31, as illustrated in FIG. 3. Once the radioactive waste 32 is in place, the bentonite-based material is sprayed in accordance with a spray method, to form the water-impervious layer 33. The supersonic nozzle 2 is used for spraying the bentonite-based material. For forming the water-impervious layer 33, firstly the bentonite-based material is sprayed by compressed air, using the supersonic nozzle 2 from above, around the position at which the radioactive waste 32 is placed in the gallery 31.

The compressed air supplied from the compressor 5 and the bentonite-based material supplied from the bentonite container 6 are mixed in the connecting member 20 of the supersonic nozzle 2. The bentonite-based material mixed with the compressed air in the connecting member 20 is conveyed to the tip member 10. At the tip member 10, the compressed air passes from the compression portion 15 through the constriction portion 14, and flows through the expansion portion 16. The nozzle diameter decreases from the compression portion 15 to the constriction portion 14, whereby the flow velocity of the compressed air increases. Once it has becomes supersonic upon passing through the constriction portion 14, the flow velocity of the compressed air becomes further accelerated since the expansion portion 16 has a wider diameter than the constriction portion 14. The bentonite-based material, which is transported up to the jet orifice 11 together with the compressed air, is jetted through the jet orifice 11 at supersonic speed.

By being jetted at supersonic speed, the bentonite-based material forms a bentonite matrix of desired density, whereby there can be formed a bentonite layer of high dry density. Herein the supersonic nozzle 2 is used as the spraying nozzle, and hence the bentonite-based material can be sprayed at high speed i.e. supersonic speed without using a large compressor.

When, for instance, the bentonite-based material is sprayed with a supersonic nozzle 2 facing downward and the spraying direction is more downward than the horizontal direction, the pressure involved is not too high, of 0.3 to 0.7 MPa. Even using an ordinary-pressure compressor, there can be achieved a high dry-density bentonite-based material, of 1.6 $Mg/m^3$, found in bentonite-type artificial barriers (water-impervious layer) for construction. Orienting thus the spraying direction more downward than the horizontal direction allows reducing spraying losses. Moreover, the bentonite-based material need not be adhered to the work surface, and hence the amount of liquid used, such as water or the like, can be kept to a minimum.

Figure 4:
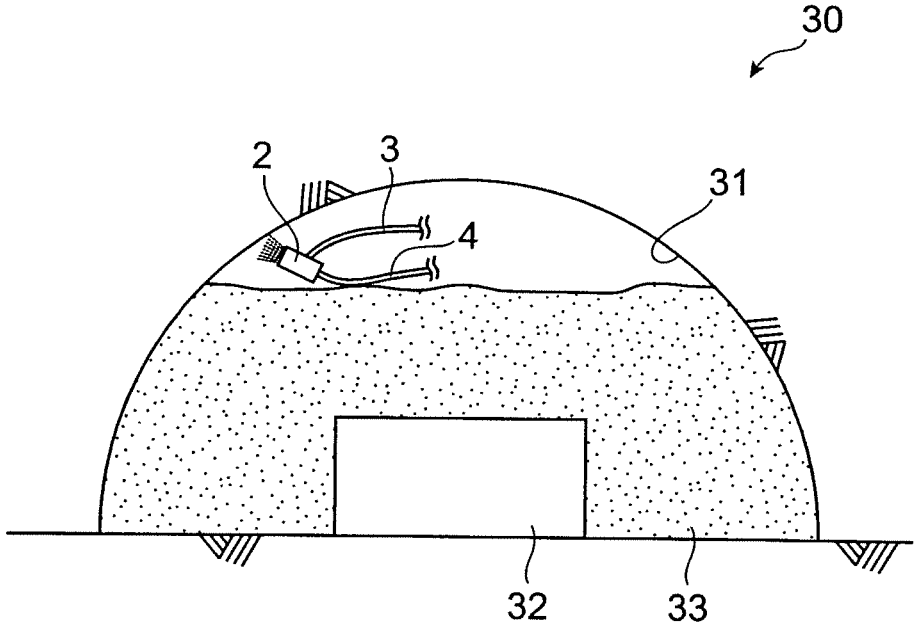
FIG. 4 is a front-view cross-sectional diagram continuing the process of FIG. 3.

The bentonite-based material goes on being sprayed thus, as illustrated in FIG. 4, forming a water-impervious layer 33 on the lower portion of the gallery 31 over a wide area, whereupon the water-impervious layer 33 becomes formed on the upper portion of the gallery 31. Herein, the bentonite-based material is sprayed, for instance, by directly orienting the supersonic nozzle 2 toward the inner surface of the gallery 31, as illustrated in FIG. 4, to form thereby the water-impervious layer. Thereafter, as illustrated in FIG. 5, the gallery 31 becomes fully buried with the bentonite-based material so that the water-impervious layer 33 is formed over all the interior of the gallery 31. The flow of groundwater surrounding the gallery 31 is prevented thus from reaching the radioactive waste 32.

Through such a spray method using the bentonite-based material according to the present embodiment, there can be formed a water-impervious layer 33 of high dry density, and thus high water imperviousness, which is required in a radioactive waste disposal facility 30 for the disposal of radioactive waste 32. The radioactive waste disposal facility 30 can be thus developed easily, without resorting to large-scale plants and/or equipment such as large cranes, compacting rollers or the like. Moreover, forming the water-impervious layer 33 by a spray method allows forming easily the water-impervious layer 33 even at narrow sites. Also, using the supersonic nozzle 2 allows spraying bentonite-based material at high seed, i.e. at supersonic speed, employing the ordinary-power compressor 5 alone. This allows easing the performance of spraying equipment such as the compressor 5 and the like, while requiring no change of working method depending on the work site, all of which simplifies the building process and affords cost reductions as a result.

Figure 6:
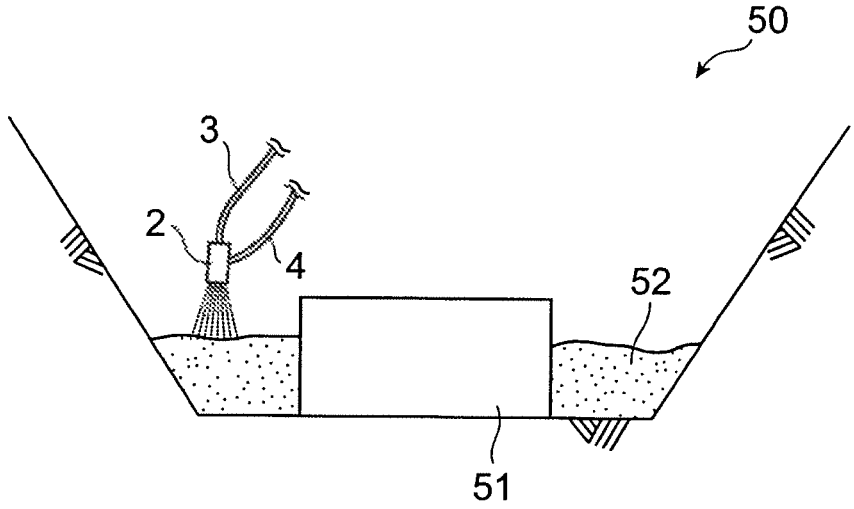
FIG. 6 is a front-view cross-sectional diagram of the building process of an open-air waste disposal facility.

Other than the building of a radioactive waste disposal facility 30 such as the one described above, the spray apparatus 1 according to the present embodiment can also be used during backfilling of so-called open-air waste disposal facilities (shallow-land disposal facilities). FIG. 6 is a diagram illustrating backfilling of an open-air waste disposal facility using the spray apparatus 1 according to the present embodiment. As illustrated in FIG. 6, waste 50 is placed in a trough-like open-air waste disposal facility 51, then a bentonite-based material is sprayed through the supersonic nozzle 2 of the spray apparatus 1 around the waste 51, to form a water-impervious layer 52, as a bentonite layer, in which the waste 51 can be buried.

Figure 7:
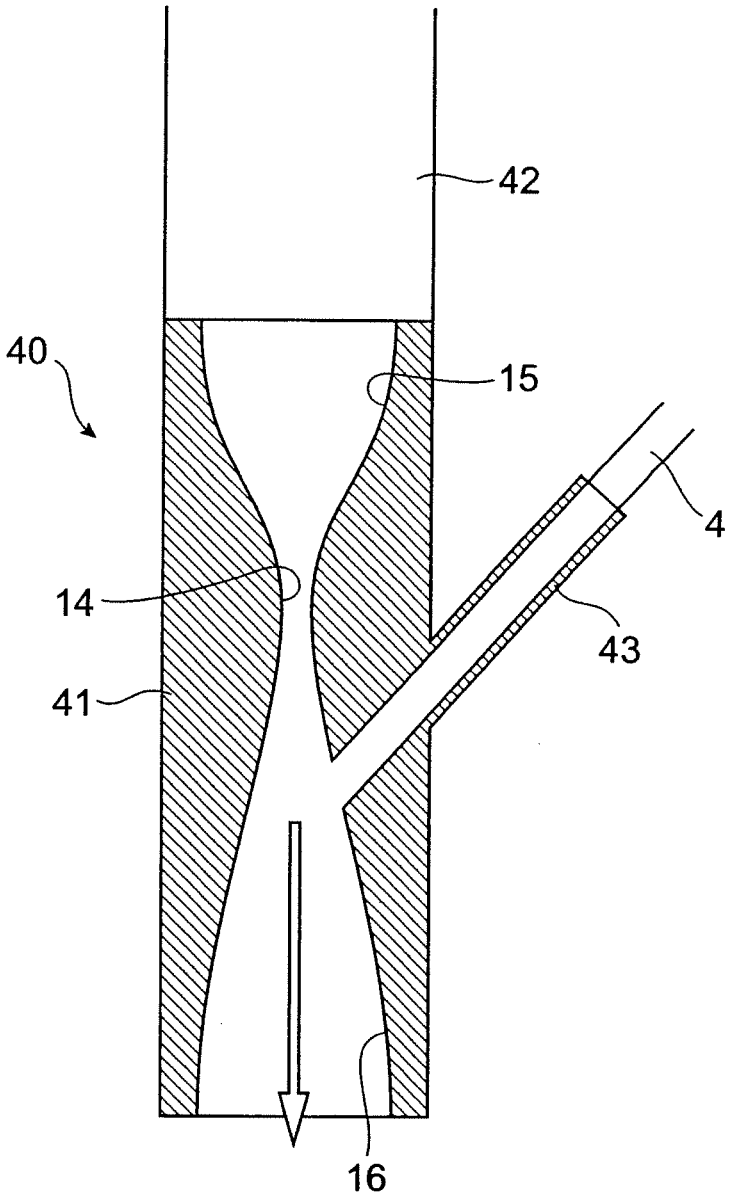
FIG. 7 is a cross-sectional diagram of another example of a supersonic nozzle.

The supersonic nozzle 40 illustrated in FIG. 7 can be used instead of the supersonic nozzle 2 used in the above embodiment. The supersonic nozzle 40 has a tip member 41 and a connecting member 42, but herein there is no branch pipe member provided on the connecting member 42. Instead, a branch pipe member 43 is provided on the tip member 41. A bentonite container (not shown in the figure) is connected to the branch pipe member 43 via the second hose 4. The branch pipe member 43 is formed at a position communicating with the expansion portion 16, more toward the jet orifice 111 than the constriction portion 14. Other than that, the configuration is identical to that of the above embodiment.

In the supersonic nozzle 40, the bentonite-based material is supplied more toward the jet orifice 11 than the constriction portion 14, and hence the bentonite-based material can avoid passing through the constriction portion 14. This affords more design freedom for the outer diameter of the constriction portion 14, the shape of the expansion portion 16 and so forth, as the constriction portion 14 is not limited by the maximum particle size of the bentonite-based material.

Test 1

Figure 8:
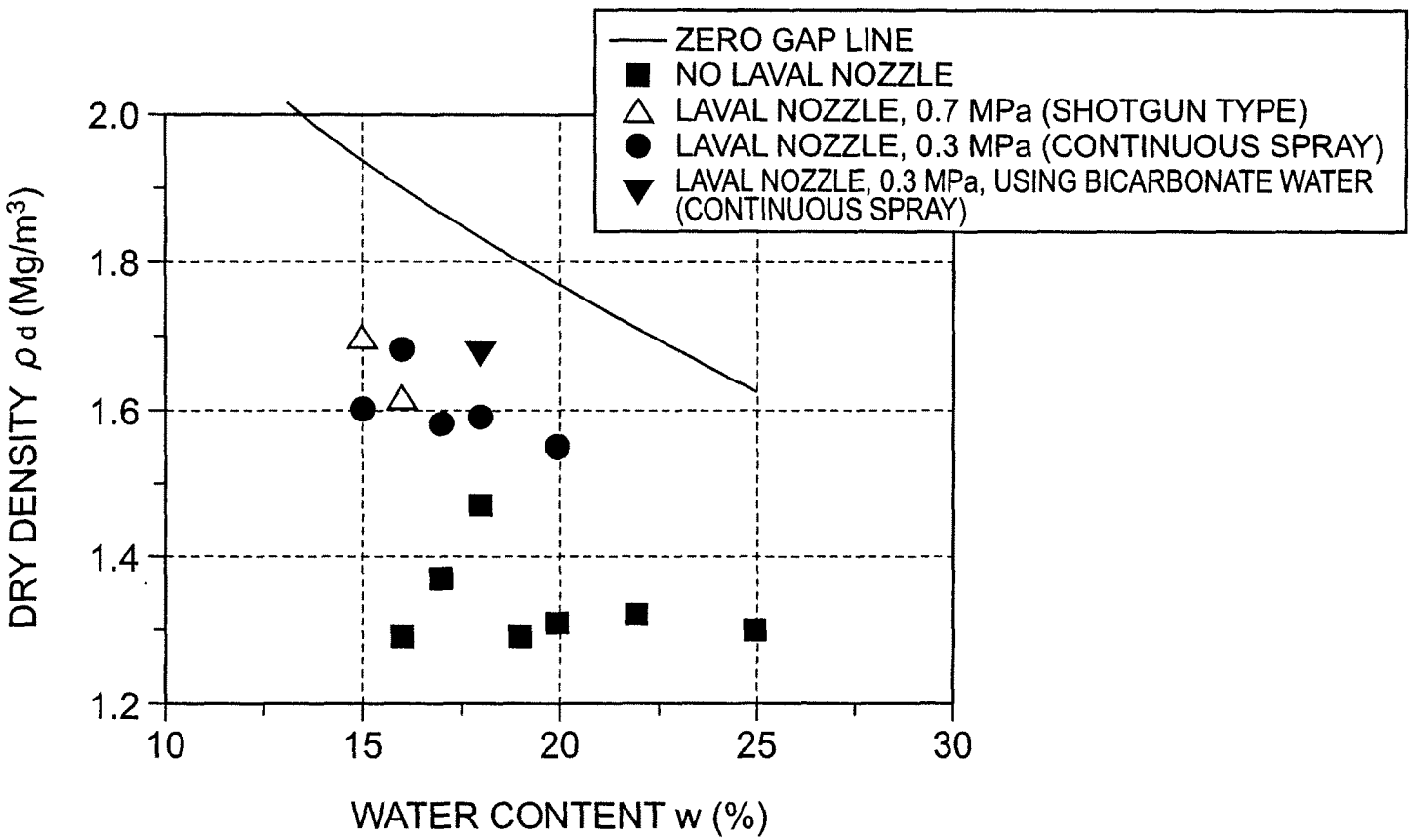
FIG. 8 is a graph illustrating a relationship between water content and dry density after spraying in an example of the invention and a comparative example.

An explanation follows next on indoor spraying tests carried out on a bentonite-based material and a liquid such as water. FIG. 8 is a graph illustrating the results of such indoor spraying tests. In the tests there was carried out high-density spraying of bentonite for spraying using a supersonic nozzle (Laval nozzle) and using an ordinary non-supersonic nozzle. FIG. 8 illustrates the relationship between the water content and the dry density of the sprayed bentonite.

As can be seen in FIG. 8, dry density versus water content was greater when a supersonic nozzle (Laval nozzle) was used than when no supersonic nozzle was used (no Laval nozzle). Thus, using the supersonic nozzle according to the present invention allows increasing the dry density of the sprayed material, i.e. of the water-impervious layer, even for a bentonite-based material having a water content of 15 to 25%.

Test 2

The following test was carried out for determining a suitable water content of the bentonite-based material. In the test there was used a supersonic nozzle having a throat diameter of 19 mm and set to a spraying range of 1000 mm. The test measured the rebound rate of bentonite-based material during a spraying experiment, as well as the dry density of the sprayed bentonite-based material. The bentonite-based material used had a particle size not larger than 5 mm. The rebound rate is a value in which the weight of adhered bentonite-based material is divided by the weight of sprayed bentonite-based material. The adhesion rate of bentonite-based material is determined then by subtracting the rebound rate from 1. The results are illustrated in FIG. 9.

Figure 9:
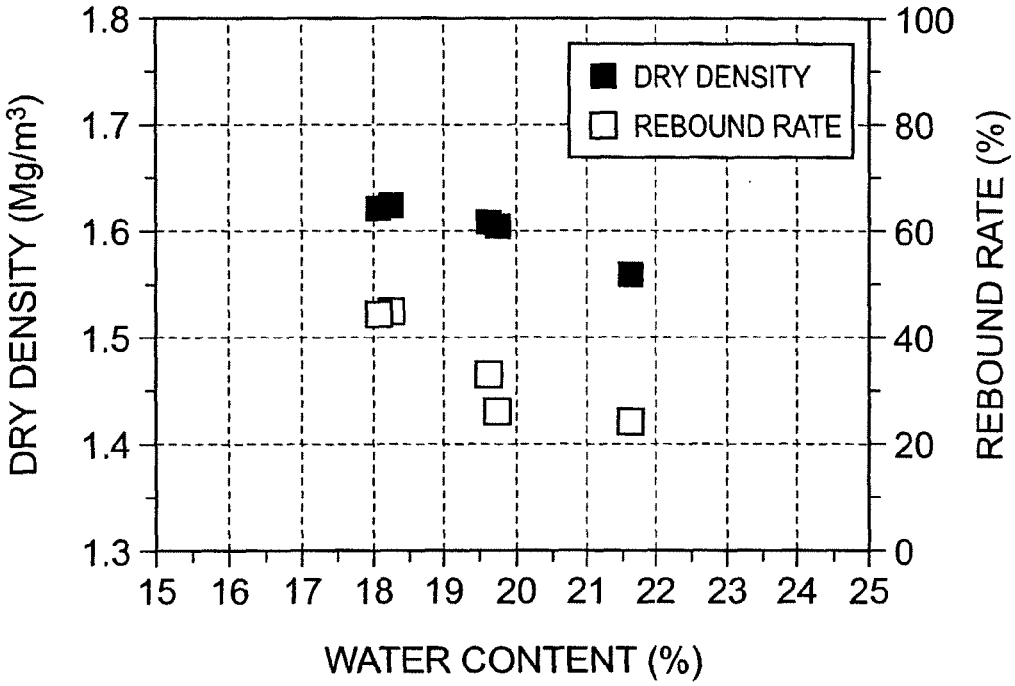
FIG. 9 is a graph illustrating a relationship between water content and dry density after spraying in a test of the present invention.

As FIG. 9 shows, the dry density becomes maximal when the water content is 18%, and thus the optimum water content for the bentonite-based material used herein is 18%. At a water content below 17%, which is smaller by 1% than the optimum water content, the rebound rate became excessive and the dry density could not be measured. The test was thus discontinued.

On the other hand, when the water content exceeds 22%, which is greater than the optimum water content by 4%, the rebound rate became extremely low. However, the bentonite-based material adhered to the supersonic nozzle and/or the piping for delivery of the bentonite-based material, clogging the foregoing. The test was thus discontinued.

In terms of optimum water content, a bentonite-based material having a high adhesion rate can be achieved thus by setting a water content range that excludes water contents smaller by not more than 1% or larger by not less than 4% than the optimum water content. Doing so allows also reducing the likelihood of occurrences such as clogging by the bentonite-based material.

The present invention is not limited, however, to the above-described preferred embodiment thereof. In the above embodiment, for instance, the bentonite-based material was mixed with water to yield a liquid, but water may be replaced by water containing carbonate ions. The water containing carbonate ions used herein is an aqueous solution of sodium bicarbonate (hereafter, "bicarbonate water"). Other than bicarbonate water, any aqueous solutions capable of providing $CO_3^{2-}$, $HCO_3^{2-}$ and so forth may also be used as the water containing carbonate ions. Examples thereof include, for instance, aqueous solutions of carbonate salts such as sodium carbonate, potassium carbonate, iron carbonate and the like, and aqueous solutions of bicarbonate salts such as potassium bicarbonate, iron bicarbonate and the like. The aqueous solutions are preferably saturated.

The water content in the liquid such as water containing carbonate ions or the like in the bentonite-based material is preferably adjusted so as to range from 15 to 30%. The bentonite and a liquid such as water containing carbonate ions can be mixed through pressure-feeding of the bentonite by compressed air immediately prior to spraying onto the water-impervious layer formation site. At the water-impervious layer formation site there forms then a mixture of bentonite and the liquid such as water containing carbonate ions, the mixture being sprayed onto the water-impervious layer formation site. Alternatively, there may be prepared beforehand a mixture by mixing bentonite with the liquid such as water containing carbonate ions, followed by spraying of the mixture onto the water-impervious layer formation site through pressure-feeding with compressed air.

The bentonite-based material has herein water containing carbonate ions, which is water containing interlayer cations, including cations identical to those of bentonite, and hence adherence of bentonite with itself and/or to the water-impervious layer formation site is facilitated during spraying. A high bonding ability is thus afforded, even for a low water content, that allows achieving sufficient adhesion and water-imperviousness, also with a spray material having a low water content.

Further, the water containing interlayer cations in the bentonite-based material comprises the same cations (Na ions, Ca ions and the like) as the interlayer cations of bentonite. This allows reducing thus the environmental burden. Moreover, the water containing carbonate ions is an inorganic material, and hence alteration thereof into an organic material such as alcohol or the like is not a concern. As a result, the water containing carbonate ions becomes diluted with groundwater after closure of the gallery 31 once the radioactive waste disposal facility 30 is completed. The invention can afford thus the same performance, in terms of imperviousness and the like, as in conventional methods such as heaping of bentonite blocks or the like.

Meanwhile, the surface of the gallery 31 of the waste disposal facility according to the present embodiment is formed of cement-based concrete, and hence the (water containing) carbonate ions have the effect of compacting the surface layer of concrete.

In the above embodiment there was illustrated an example in which an artificial barrier (water-impervious layer) was built in a radioactive waste disposal facility, but the spray method for bentonite-based material according to the present invention can also be used for building a water-impervious layer 52 that does not require such extremely high imperviousness but a certain degree of imperviousness.

The above embodiment involved an instance of so-called wet spraying, in which a bentonite-based material is mixed beforehand with a liquid such as water. Spraying, however, is not limited to wet spraying, and may be carried out through so-called dry spraying, using an supersonic nozzle 2 (40), and in which the bentonite-based material and a liquid such as water or water containing interlayer cations are supplied separately, and the bentonite-based material and the liquid are mixed with compressed air that is jetted through the supersonic nozzle 2 (40).

Figure 10:
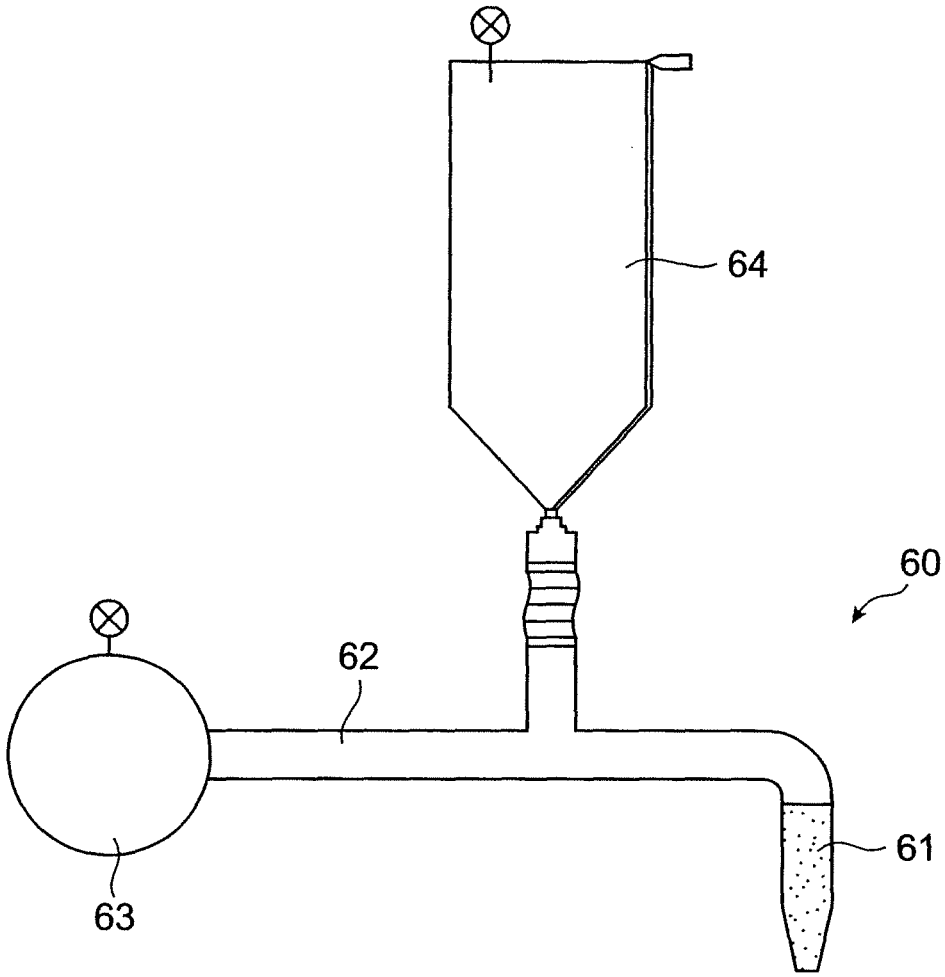
FIG. 10 is a schematic diagram illustrating a bentonite-based material spray apparatus according to a variation.

In the above embodiment there is provided a branch pipe member 22 (43) in the supersonic nozzle 2 (40), and compressed air and the bentonite-based material are mixed in the supersonic nozzle 2 (40). However, the mixing site of the compressed air and the bentonite-based material is arbitrary, and for instance the bentonite-based material and compressed air may be mixed, for instance, at a position before the supersonic nozzle 2 (40). FIG. 10 is a schematic diagram of a spray apparatus according to a variation of such an example. As illustrated in FIG. 10, a spray apparatus 60 according to the present variation comprises a supersonic nozzle 61. In contrast to the supersonic nozzle 2 (40) according to the above embodiment, the supersonic nozzle 61 has a structure in which no branch pipe member 22 (43) is provided. The supersonic nozzle 61 is connected to a compressor 63 and a bentonite container 64 via a three-way hose 62. When compressed air is supplied from the compressor 63 to the supersonic nozzle 61, the resulting negative pressure in the three-way hose 62 causes bentonite-based material from the bentonite container 64 to flow into the three-way hose 62. The bentonite-based material and compressed air mix thereupon in the three-way hose 62, and are supplied as is to the supersonic nozzle 61. The bentonite-based material is sprayed from the supersonic nozzle 61, at supersonic speed, onto the work surface.

The invention claimed is:

1. A bentonite-based material spray method for forming a bentonite layer by spraying a bentonite-based material having as a main material thereof bentonite or a mixture containing bentonite, the method comprising:

supplying compressed air to a supersonic nozzle formed with a compression portion, a constriction portion and an expansion portion, said compressed air being accelerated to supersonic speed in the process of being supplied to said expansion portion by passing through said constriction portion, and jetting the supersonic compressed air from a jet orifice formed downstream of the expansion portion;

mixing a bentonite-based material with said compressed air, and forming a bentonite layer by wet spraying said bentonite-based material mixed with said compressed air, particle size of bentonite contained in said bentonite-based material is not larger than 10 mm, said bentonite-based material is a mixture containing said main material and a liquid; and using a material as said main material wherein a dry density correlating to the content of liquid within said bentonite-based material is equal to or greater than a predetermined dry density at the point where the content of said liquid is equal to an optimum water content of the material, wherein an upper limit of the content of said liquid in said bentonite-based material is set to a value greater by 4% than the optimum water content and the lower limit of the content of said liquid in said bentonite-based material is set to a value smaller by 1% than the optimum water content.

2. The bentonite-based material spray method according to claim 1, comprising:

determining the upper limit of the content of said liquid in said bentonite-based material on the basis of a possibility of closing of said supersonic nozzle during passage of said bentonite-based material through said supersonic nozzle; and determining a lower limit of the content of said liquid in said bentonite-based material on the basis of adherence of said bentonite-based material.

3. The bentonite-based material spray method according to claim 2, wherein said predetermined dry density is 1.6 ($Mg/m^3$).

4. The bentonite-based material spray method according to claim 1, wherein said compressed air and said bentonite-based material are mixed more towards the jet orifice than the constriction portion in said supersonic nozzle.

5. The bentonite-based material spray method according to claim 1, wherein said bentonite-based material is sprayed more downward than a horizontal direction.

* * * * *